US005098104A

United States Patent [19]

Kane

[11] Patent Number: 5,098,104

[45] Date of Patent: Mar. 24, 1992

[54] WATER SOLUBLE GOLF BALL

[76] Inventor: Pat E. Kane, P.O. Box 1044, Bonita, Calif. 92002

[21] Appl. No.: 716,227

[22] Filed: Jun. 17, 1991

[51] Int. Cl.[5] ..... A63B 37/12; A67B 37/02

[52] U.S. Cl. ..... 273/220; 273/235 R; 273/230; 273/218

[58] Field of Search ..... 273/218, 212, 62, 220, 273/230, 235 R

[56] References Cited

U.S. PATENT DOCUMENTS 4,014,541 3/1977 Desmarais ..... 273/212 X
4,697,807 10/1987 Boundy ..... 273/183 CX

FOREIGN PATENT DOCUMENTS 9584 of 1890 United Kingdom ..... 273/218

*Primary Examiner*—George J. Marlo
*Attorney, Agent, or Firm*—Frank D. Gilliam

[57] ABSTRACT

A water soluble golf ball suitable to provide proper playing characteristics comprised of an outer skin and an inner core formed from water soluble material which is dissolvable by water after a predetermined time span.

11 Claims, 1 Drawing Sheet

WATER SOLUBLE GOLF BALL

BACKGROUND OF THE INVENTION

1. Field of the Invention

This invention relates to golf balls. More particularly it relates to water-soluble golf balls.

2. Prior Art

In the United States and throughout the industrialized world golf is one of the most popular leisure sports enjoyed by a wide range of citizens. A large portion of this golfing population practices their golfing ability by the hitting dozens of golf balls at public and private driving ranges. A familiar site to many a golfer is the thousands of golf balls which cover the driving range area prior to their retrieval.

Another popular pastime for citizens on vacation is taking of sea cruises aboard the many ships and cruise lines who cater to seagoing vacationers. In the not too distant past many a seagoing golfer was able to practice his golf ball driving skills aboard ship by driving golf balls off of the ship into the sea.

Because of the ill effects the thousands of golf balls ejected from the cruise ships were having on the ocean environment and the sea life therein, and because of a statute enacted by the International Maritime Organization banning the dumping of refuse containing plastic into the world's oceans, the practice of driving golf balls has been banned by most cruise ship lines. Since golf balls are made of rubber and other waterproof materials, the balls driven from cruise ships into the sea, or from land based driving ranges into a water hazard continue to exist in that environment for years. These golf balls, when ingested by sea life and fresh water dwelling creatures, may cause death or illness due to choking or bowel obstruction.

Since current golf balls in use and disclosed by prior art noted below are essentially made to endure in the golf club environment for years, driving ranges used by the thousands of people practicing swing and distance driving have been limited to spaces of land which allow for the easy retrieval of the golf balls used thereon. However, if golf balls were to dissolve into the environment into which they were driven, not only would golf practice at sea be safe for sea animals and the ocean environment, but additional areas of land would become available along lakes, sea shores, swamps, and other areas for since the balls would no longer need to be retrieved. The introduction of such a water soluble golf ball would thus open up such land for additional driving ranges. It is therefor desirable to provide a water soluble golf ball which will allow the driving of golf balls from cruise ships and in other areas currently precluded from such play with permanent style golf balls.

U.S. Pat. No. 4,014,541 (Desmarias) teaches a golf tee composed of water thermoplastic material which is water soluble. While addressing the need for water soluble products in the golfing environment this patent does not instruct as to the manufacture of a golf ball which is soluble.

U.S. Pat. No. 2,374,692 (Miller) teaches an oxidized soy bean oil mixed with rubber materials to produce a material of uniform composition for the covering of golf balls. The intent of Miller, however, is to use the soy bean oil to produce a long lasting golf ball cover which is extremely tough and resilient and similar in performance to vulcanized rubber covers. Thus, the Miller patent does not instruct on the use of natural and water soluble substances for the production of water soluble golf balls.

U.S. Pat. Nos. 2,363,059 (C. W. Green), 2,122,279 (Crane), 2,229,170 (C.W. Green), 2,074,808 (Rickey), 1,202,490 (Davis), 785,184 (Saunders), 699,813 (Richards) and 710,750 (Cavanagh) all deal with a method of making a golf balls. However all the golf balls disclosed in the aforementioned patents deal with the method of manufacturing a long lasting golf ball from various natural and synthetic components and thus teach away from a method for the manufacture of a water soluble or disposable golf ball.

SUMMARY OF THE INVENTION

In summary, the present invention comprises a golf ball whose skin and core are composed of materials which are water soluble and will dissolve in either salt or fresh water. This invention has physical characteristics similar to currently used regulation golf balls and has playing characteristics closely resembling that which is expected in conventional golf balls.

The preferred material for the outside skin component of this invention is a water soluble cellulose compound, although other suitable water soluble materials suitable for the purposed intended may be used. For the purposes of explanation of this invention, a preferable cellulose compound consists of paper pulp, but is not limited to, paper pulp, sawdust, lint, straw, thread, twine, or leaves. The cellulose compound is prepared by grinding the stock material to achieve a flock like consistency. The flock like material is then blended with a water soluble polymer at a ratio such as, for example, ten parts cellulose flock like material to one part water soluble polymer by weight. A water soluble polymer for the purposes of this invention consists of, but is not limited to, the following class of materials: gelatin, agar or processed seaweed, non toxic white glue, and the like. The resulting homogeneous mixture becomes doughy and suitable for compression molding or static casting of the golf ball outer skin.

In the manufacture of the outer skin of this invention preferably a predetermined amount of the water soluble cellulose compound mixture is placed in a mold preheated to approximately 250 degrees fahrenheit. The mold is then closed for a suitable length of time using mechanical or hydraulic pressures from one pound per square inch to 1500 pounds per square inch. Depending on the mold temperature the cure time for the skin component is approximately 45 to 60 seconds. However, mold temperature and variables in the mixture of the cellulose flock compound will effect this cure time. Upon completion of this curing process a hollow core half sphere shaped outer skin component of the golf ball invention is produced. Two halve spheres joined provide the golf ball outer skin.

The materials for the base slurry used to construct the core of the golf ball invention include, but are not limited to, the following components: sodium bicarbonate, sodium citrate, sodium chloride, or diatomaceous earth, or the like water soluble materials. These water soluble materials when used singularly or combined as a blended composite will yield the required mass necessary for proper golf ball performance characteristics. In the event additional mass is required for the core, low carbon steel buck shot or fine steel filings or like nature destructible materials may be added to the base slurry of the core material.

In the manufacture of the core component of the golf ball, a predetermined amount of the singular or combined material blended base slurry is mixed with a water soluble polymer as aforementioned, at a mix ratio of 15 parts slurry material to 1 part water soluble polymer by weight. After thorough mixing a dry moldable doughy material results.

A predetermined amount of the doughy material used in the core component is placed into a die cavity which has been preheated to approximately 375 degrees. The die is then closed to stops within 30 seconds of the placing of the doughy material therein whereupon a constant pressure is exerted against the mold stops of no less than 2000 pounds per square inch for a period 90 seconds or less.

The golf ball comprises two skin components attached over the core. A water soluble non toxic bonding agent is applied to the contacting surfaces of all three of the components. The two skin half spheres are abutted together around the core component and compressed by the use of a jig or other means upon the core for a sufficient time to allow the water soluble bonding agent to cure. The skin components and the core component are designed and molded to be self aligning at assembly and thus aligning fixtures are not required to maintain concentricity.

An object of this invention is to provide a golf ball which will dissolve into the environment into which it is driven by its user.

Another object of this invention is to provide a golf ball which will prove harmless to the animal life which occupies the environment into which the golf ball is placed.

Another object of this invention is to provide a water soluble golf ball with playing characteristics not unlike a conventional golf ball.

BRIEF DESCRIPTION OF DRAWING FIGURES

DETAILED DESCRIPTION OF THE PREFERRED EMBODIMENT OF THE INVENTION

Figure 1:
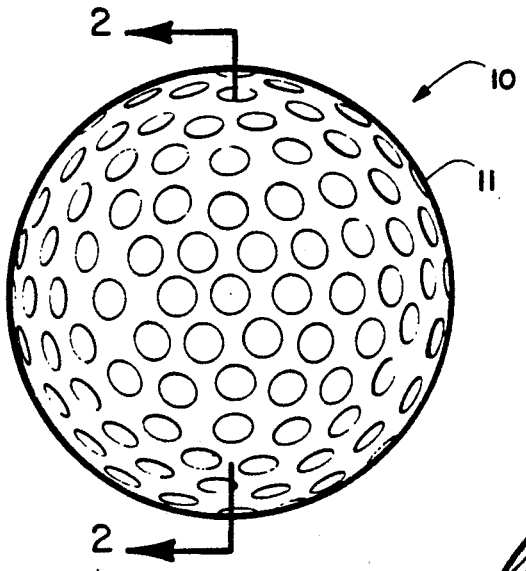
FIG. 1 is a side view of the water soluble golf ball invention.

Referring now to the various drawing figures. The water soluble golf ball 10 has the appearance of a conventional golf ball as shown in FIG. 1.

Figure 2:
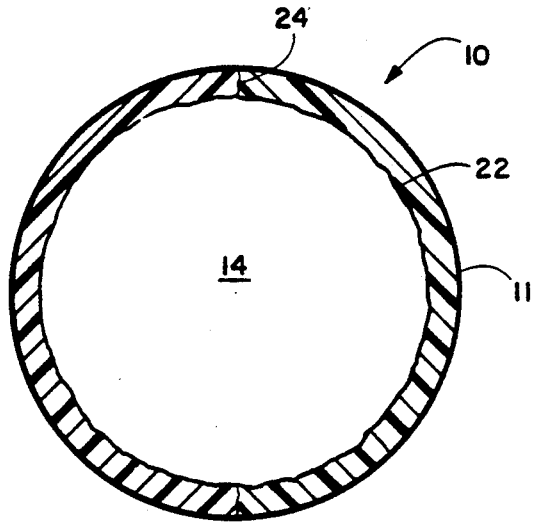
FIG. 2 is a section of FIG. 1 taken along line 2—2.
Figure 3:
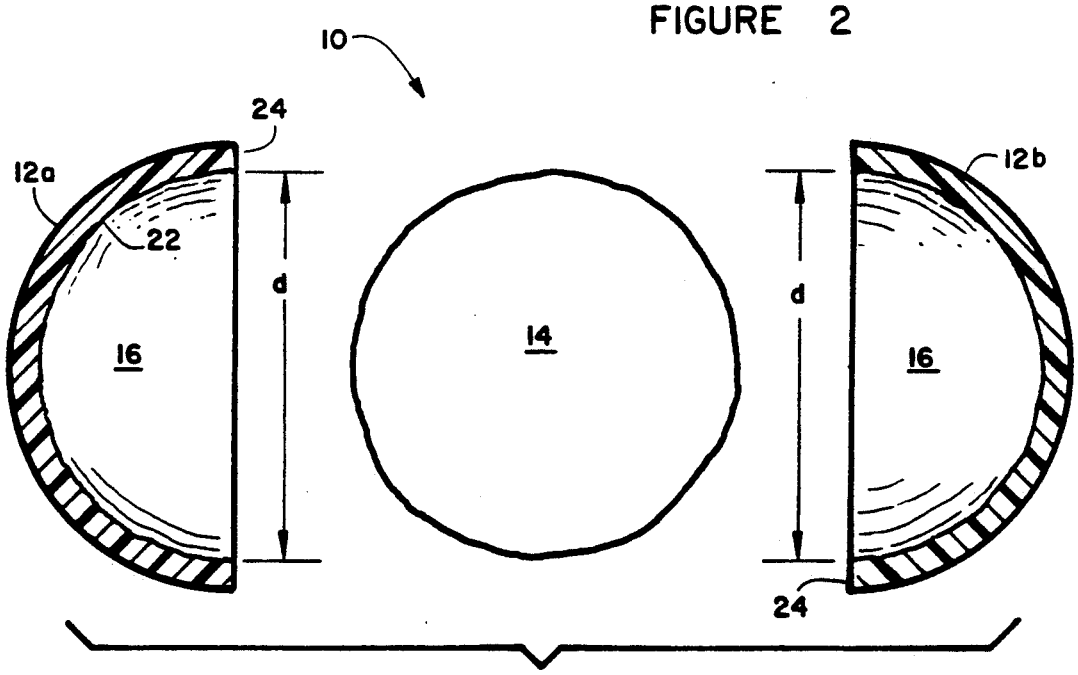
FIG. 3 is an exploded view of the three components of the invention prior to final assembly depicting the solid core component and the two hollow half sphere components of the invention.

Referring now to drawing FIGS. 2 and 3, the Water-soluble golf ball 10 of the present invention is comprised of an outer skin 11 formed by two joined hollow half or semi-spheres 12*a* and 12*b* and a central core component 14. Both the skins and core are cast or molded from a water soluble base slurry material as aforementioned which yields the required mass and weight necessary to produce a golf ball 10 with appearance and performance characteristics expected of a conventional golf ball when in use. Two outer hollow ball skin halves 12*a* and 12*b*are formed from the aforementioned cellulose compound or any other suitable water soluble material. The material for forming the skin halves is rendered to a flock like consistency and blended with a water soluble polymer or other suitable water soluble bonding material to a doughy consistency and then compression molded or static cast into the required outer dimensions and configuration to be compatible with a conventional golf ball. The two skin halves 12*a* and 12*b* have a hollow center portion 16. The hollow portions have a diameter "d" suitable for receiving a central core component 14 of substantially a diameter "d" which fits tightly therein when joined to the skin halves.

The core component 14 may be cast or molded with an outside diameter which is substantially equal to the inside diameter "d" of the hollow portion 16 of the skin halves 12*a* and 12*b*.

A water soluble non toxic adhesive 22 is applied to the outside surface of the core component 14, the inside 16 of the shin semi-spheres, and along the faying abutting surface area 24 of the skin halves 12*a* and 12*b*, pressure is then applied to substantially the entire outside dimpled skin area 2 using a jig or other suitable means, for the required amount of time for the adhesive 22 to cure and form the components into a solid water soluble golf ball 10.

In use, when the water soluble golf ball 10 is driven into water, the outer skin components 12*a* and 12*b* and the inner core component 14, dissolve harmlessly over a determined period of time.

If added weight is required in the core to closer simulate the characteristics of a conventional golf ball ferrous material or lead may be added to the slurry forming the core 14 during formation of the core. Both of these additive materials will dissolve over a period of time.

Although the present invention has been shown and described with references to particular embodiments, nevertheless, various changes and modifications obvious to one skilled in the art to which the invention pertains are deemed within the purview of the invention.

What is claimed is:

1. A golf ball comprising a core, said core, formed of a first water soluble material, and an external skin formed from two skin halves or semi-spheres, said skin halves or semi-spheres formed of a second water soluble material, distinct from said first material said two skin halves or semi-spheres and core being adhered together with a water soluble non toxic adhesive to provide a golf ball having performance characteristics of a conventional golf ball and which will dissolve in water after a period of time.

2. The invention as defined in claim 1 in which said first water soluble material is selected from the group consisting of sodium bicarbonate, sodium citrate, sodium chloride, or diatomaceous earth or combinations thereof.

3. The invention as defined in claim 2 in which said second water soluble material is formed from water soluble material selected from the group consisting of gelatin, agar, processed seaweed, and non toxic glue.

4. The invention as defined in claim 3 additionally comprises the addition of a ferrous metal to the core component.

5. The invention a defined in claim 2 additionally comprises the addition of a ferrous metal to said core component.

6. The invention as defined in claim 1, wherein said second water soluble material is selected from a group consisting of gelatin, agar, processed seaweed, and non-toxic glue or combinations thereof.

7. The invention as defined in claim 6 additionally comprises the addition of a ferrous metal to said core component.

8. The invention as defied in claim 1 additionally comprises the addition of a ferrous metal to said core component.

9. The invention as defined in claim 1 wherein said external skin halves or semi-spheres are formed from paper pulp.

10. The invention as defined in claim 1 wherein said core is formed from diatomaceous earth.

11. A process of producing water soluble golf balls which consists of the steps of enclosing within a water soluble hollow sphere comprising of two half or semi-spheres a water soluble core comprised of suitable water soluble material and subjecting said hollow sphere and said core to an elevated temperature and pressure to yield the required mass for proper conventional golf ball playing characteristics.

* * * * *